US005591054A

United States Patent [19]

Okada et al.

[11] Patent Number: 5,591,054

[45] Date of Patent: Jan. 7, 1997

[54] MALE TERMINAL FITTING AND METHOD OF PRODUCING THE SAME

[75] Inventors: Hajime Okada; Masaaki Kobayashi; Mitsuhiro Fujitani; Hisashi Konoya, all of Yokkaichi, Japan

[73] Assignee: Sumitomo Wiring Systems, Ltd., Yokkaichi, Japan

[21] Appl. No.: 351,614

[22] Filed: Dec. 8, 1994

[30] Foreign Application Priority Data

Dec. 8, 1993 [JP] Japan ..... 5-071673 U

[51] Int. Cl.[6] ..... H01R 13/04

[52] U.S. Cl. ..... 439/884

[58] Field of Search ..... 439/884, 601; 29/874, 882, 884

[56] References Cited

U.S. PATENT DOCUMENTS

| | | | |
|---|---|---|---|
| 2,130,424 | 9/1938 | Grant | 439/692 |
| 3,208,030 | 9/1965 | Evans et al. | 439/290 |
| 4,992,064 | 2/1991 | Steinhardt et al. | 439/884 |
| 5,073,132 | 12/1991 | Nottrott | 439/884 |
| 5,207,603 | 5/1993 | Peloza | 439/872 |

FOREIGN PATENT DOCUMENTS 60-37819 11/1985 Japan .

*Primary Examiner*—Neil Abrams
*Attorney, Agent, or Firm*—Anthony J. Casella; Gerald E. Hespos

[57] ABSTRACT

A projected portion 7 extending in a lengthwise direction of a tab portion 6 and having a given width is formed in a central section of one layer of the tab portion 6 where there is no seam before the tab portion is formed by folding back lateral sections to overlie the central section. The tab portion 6 is allowed to have a specified thickness by the presence of the projected portion 7. The tab portion 6 thus formed enables the fabrication of a more light-weight male terminal fitting at reduced costs and an increase in its strength.

2 Claims, 5 Drawing Sheets

FIG. 1
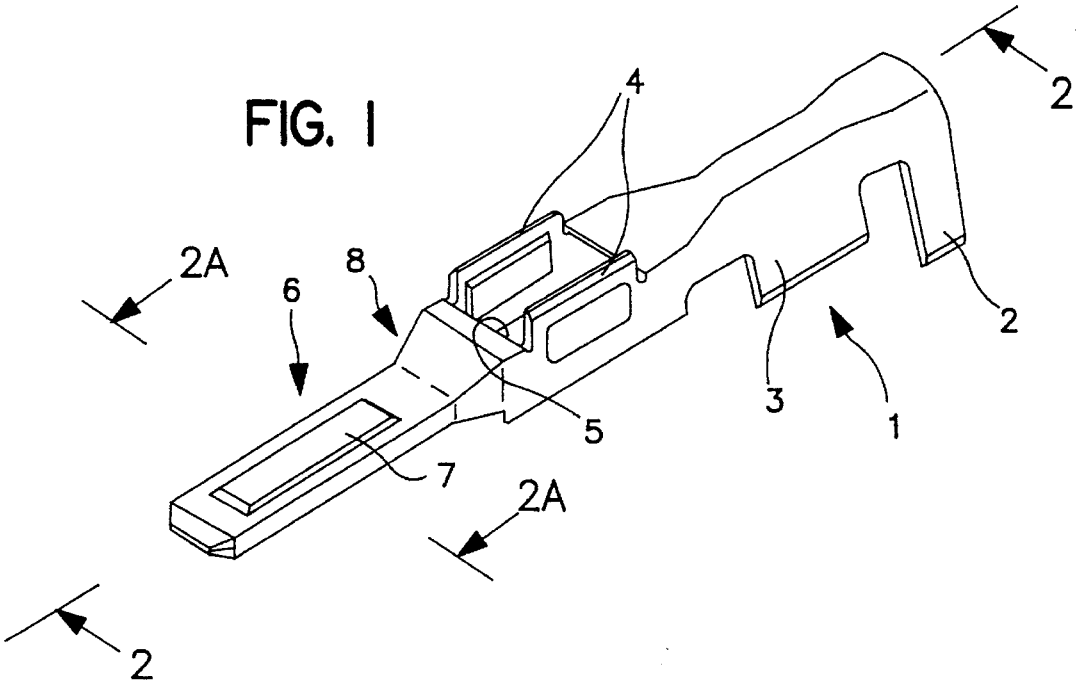
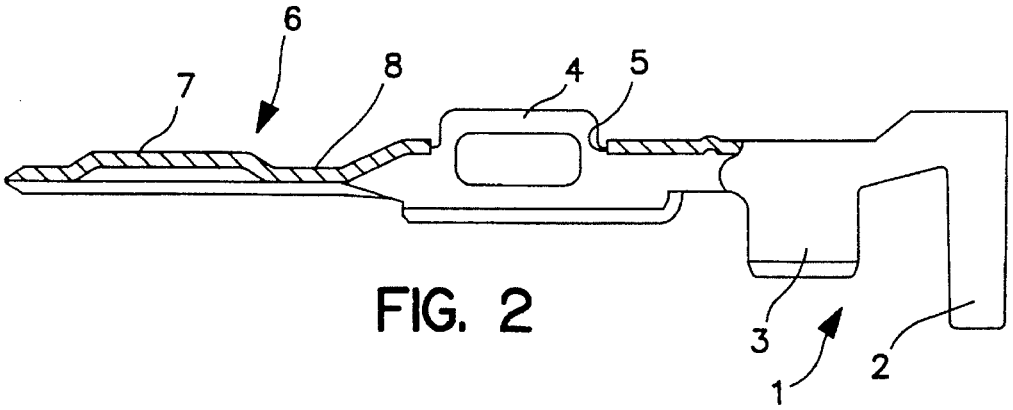
FIG. 2
FIG. 2A
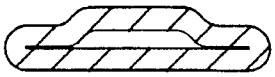

FIG. 3
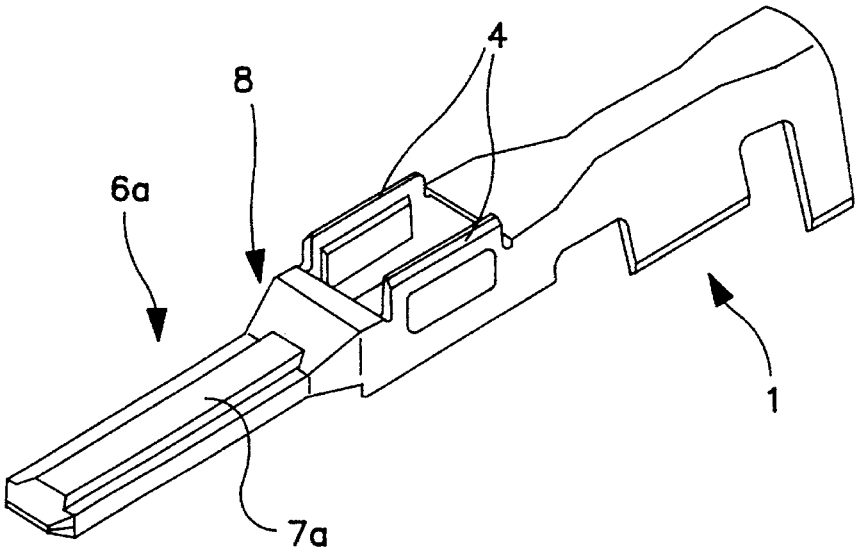
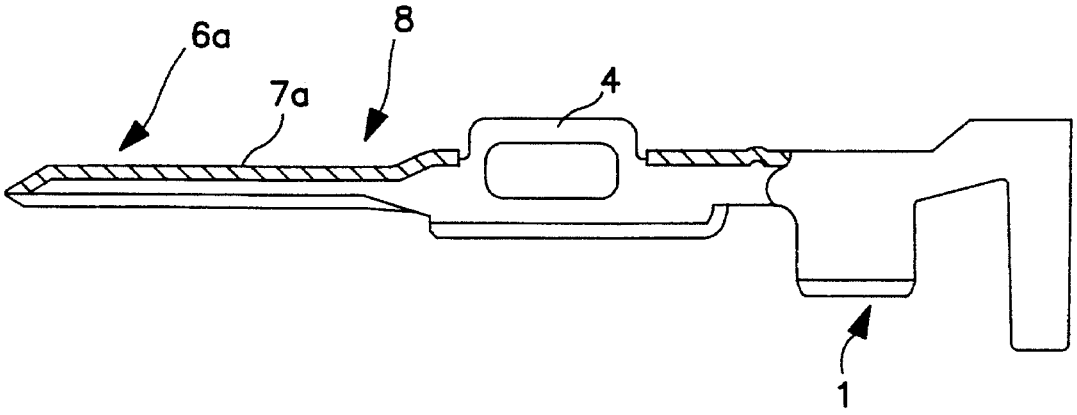
FIG. 4

FIG. 5
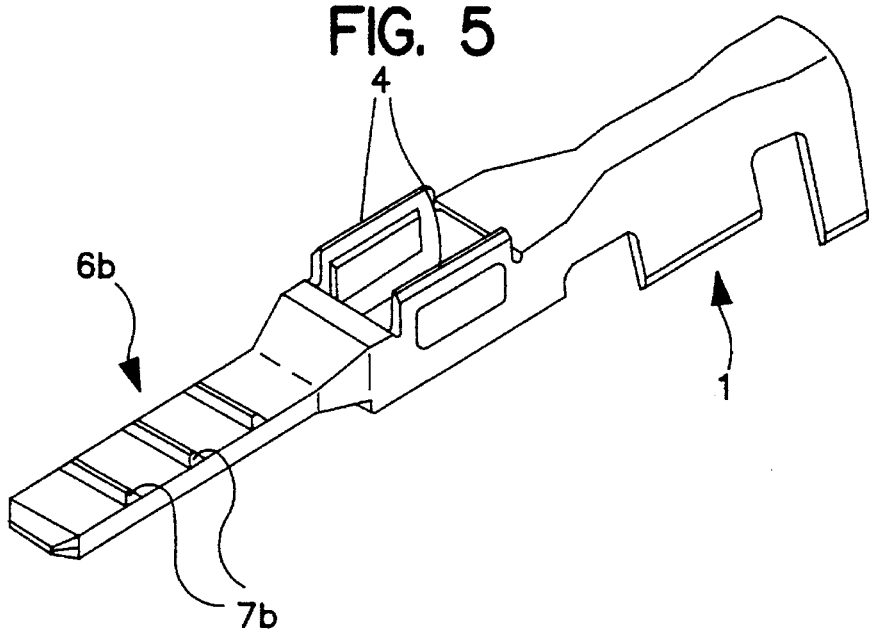
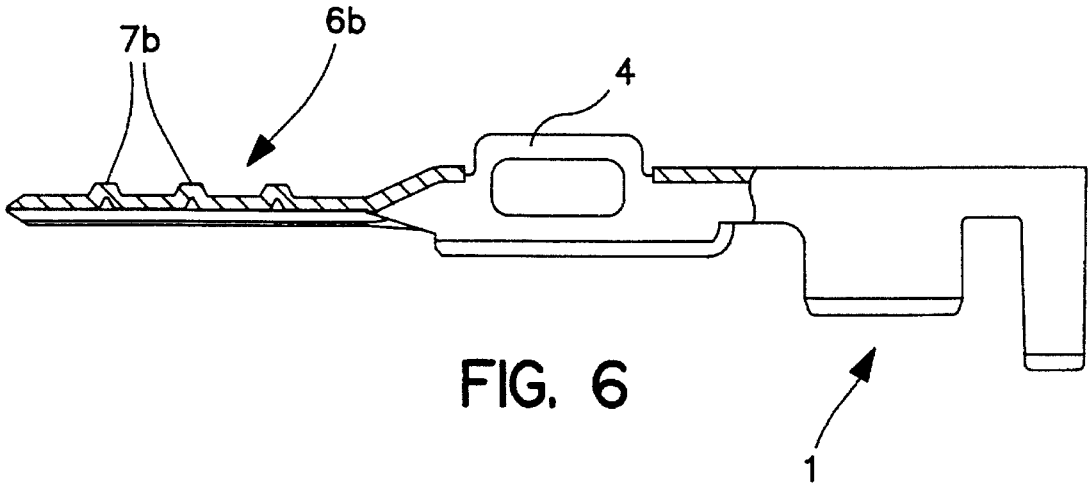
FIG. 6

FIG. 7
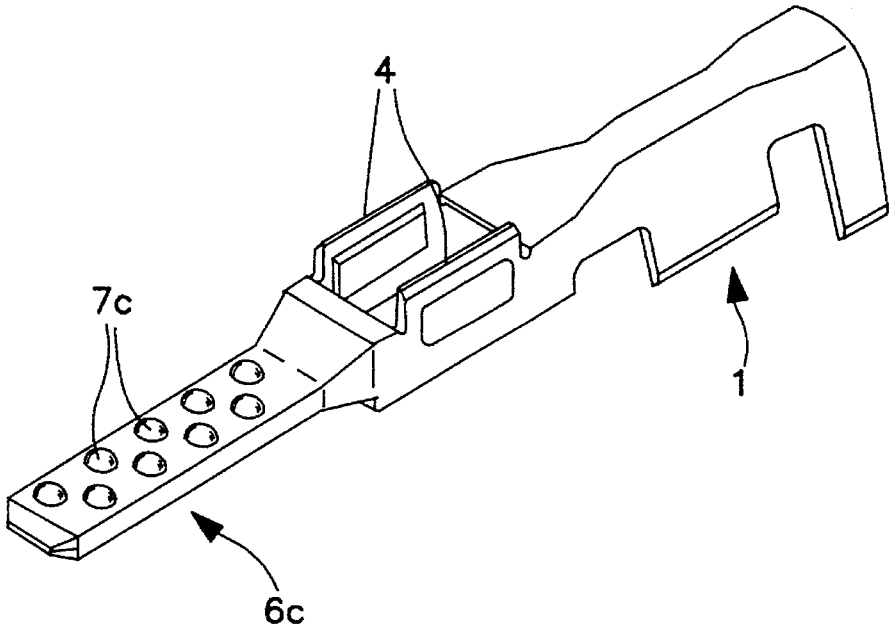
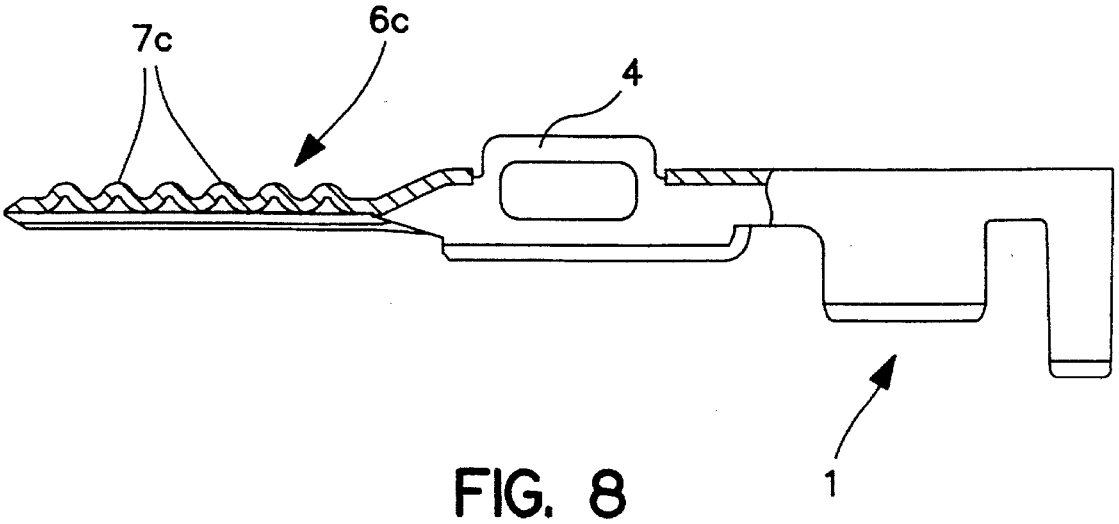
FIG. 8

FIG. 9
PRIOR ART
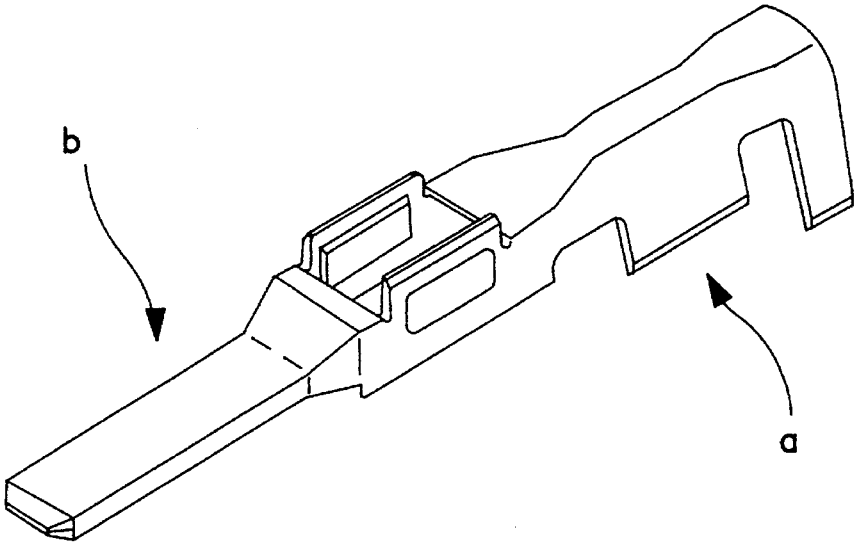
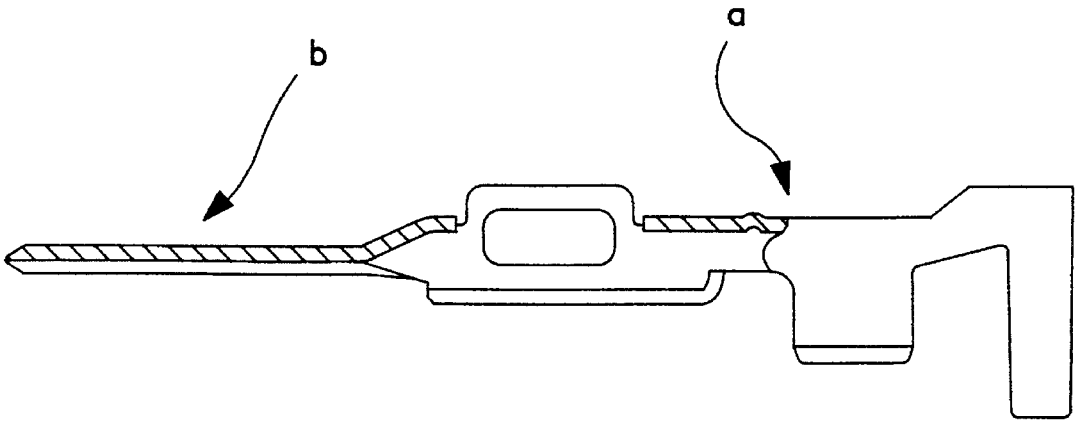
FIG. 10
PRIOR ART

MALE TERMINAL FITTING AND METHOD OF PRODUCING THE SAME

BACKGROUND OF THE INVENTION

1. Field of the Invention

The present invention relates to a male terminal fitting to be secured to an end of an electric wire for connection purposes and to a method of producing the same.

2. Description of the Prior Art

A general construction of a male terminal fitting of this kind is illustrated in FIGS. 9 and 10. A tab portion b is formed at a leading end of a barrel portion "a" formed by bending a metal plate and to be tightly secured to an end of an electric wire.

The tab portion b fulfils its connecting function by being inserted and tightly held in a mating female terminal fitting, and the width and thickness thereof are specified. On the other hand, in pursuit of easy workability, the base metal plate preferably has a smaller thickness provided that the necessary strength is assured.

Thus, the tab portion b has been conventionally formed by folding back opposite lateral ends of the base metal, i.e., by means of folding, to obtain the necessary thickness.

However, the formation of the tab portion b by merely folding back the base metal plate may, in some cases, necessitate the use of a base metal plate which is thicker than necessary in order to obtain the specified thickness of the tab portion b.

For example, let it be assumed that a base metal plate having a thickness of 0.25 mm has a sufficient strength and the specified thickness of the tab portion is 0.64 mm. If the tab portion is formed of the base metal plate having a thickness of 0.25 mm by means of folding, the thickness of the formed tab portion b is 0.25×2=0.5 mm, which falls short of the specified thickness. Thus, the base metal having a thickness of 0.3 or 0.32 mm needs to be used.

This leads to the fabrication of a male terminal fitting which is heavier and costlier than necessary.

SUMMARY OF THE INVENTION

A male terminal fitting and a male terminal fitting production method according to the present invention are developed to overcome the above problem and the invention is directed to a male terminal fitting comprising a barrel portion which is formed by bending a metal plate and with which an electric wire is to be connected, and a tab portion which is formed at a leading end of the barrel portion by folding back the metal plate, wherein at least one projected portion projecting in the thickness direction of the tab portion is formed at the tab portion.

A preferred embodiment is characterized in that the projected portion extends to a base end of the tab portion neighbouring the barrel portion.

According to the invention, the tab portion is allowed to have a specified thickness even if a thin metal plate is used. Further, the formation of the projected portion increases the strength of the tab portion itself. A projection portion may be formed in the metal plate upper layer and/or in the metal plate lower layer (which has been folded back). However, it is preferred to form the inventive projected portion in the metal plate upper layer only in order to simplify the production.

When the projected portion is formed at the tab portion, the strength of the tab portion itself is increased, but the base end of the tab portion connected with the barrel portion may not have a sufficient strength. This may lead to a limitation in making the metal plate thinner. However, if the projected portion extends, like a bead, to the base end of the tab portion, the strength at the base end is increased, thereby making it possible to use an even thinner metal plate.

According to the present invention, a metal plate having a desired thickness can be used as a base metal for the male terminal fitting. This enables the fabrication of a more light-weight male terminal fitting at a reduced cost and an increase in the strength of the tab portion itself.

BRIEF DESCRIPTION OF THE DRAWINGS

These and other objects, features and advantages of the present invention will become more apparent upon a reading of the following detailed description and accompanying drawings in which:

FIG. 1 is a perspective view showing a first embodiment,

FIG. 2 is a sectional view taken along line 212 and showing the first embodiment, FIG. 2A is a sectional view taken along line 2A—2A in FIG. 1.

FIG. 3 is a perspective view showing a second embodiment,

FIG. 4 is a sectional view showing the second embodiment,

FIG. 5 is a perspective view showing a third embodiment,

FIG. 6 is a sectional view showing the third embodiment,

FIG. 7 is a perspective view showing a fourth embodiment,

FIG. 8 is a sectional view showing the fourth embodiment,

FIG. 9 is a perspective view showing the prior art, and

FIG. 10 is a sectional view showing the prior art.

DETAILED DESCRIPTION OF THE PREFERRED EMBODIMENTS

Hereafter, the preferred embodiments of the invention are described with reference to FIGS. 1 to 8. FIGS. 1, 2 and 2A show a first embodiment of the invention. A male terminal fitting of this embodiment is formed by bending a metal plate and includes a barrel portion 1, a pair of stabilizers 4 and a tab portion 6 in this order from the rear end.

In the barrel portion 1, there are formed a pair of narrow and long insulation engaging barrels or wings 2 which are tightly secured with the insulation of an electric wire, and a pair of wide and short wire engaging barrels or wings 3 which are tightly secured with a core of the electric wire projecting from the end of the insulation. The insulation engaging barrels 2 are spaced apart from the wire barrels 3.

The stabilizers 4 are formed at opposite sides of an engaging hole 5 in which an engaging member formed in a connector housing for accommodating the male terminal fitting is fitted, and project in a direction opposite from the barrels 2 and 3. Projections are formed on the inner surfaces of the respective stabilizers 4 at such positions as to oppose the opposite sides of the engaging member which is fitted in the engaging hole 5 when the terminal fitting is inserted in the connector housing.

The tab portion 6 is formed to have a given width by folding back the opposite lateral ends of the base metal plate in a direction opposite from the projecting direction of the stabilizers 4 in such a manner that two layers of the base metal plate are formed, one layer having a seam made by the abutment of the (former) lateral edges of the base metal plate. The leading end of the tab portion 6 is tapered so as to facilitate the insertion of the male terminal fitting into a mating female terminal fitting.

Particularly in this embodiment shown in FIGS. 1, 2 and 2A, a projected portion 7 extending in the lengthwise direction of the tab portion 6 and having a given width is press-worked (e.g., by embossing) in the middle of the layer of the tab portion 6 where there is no seam before folding the tab portion 6. The tab portion 6 is allowed to have a specified thickness by the presence of the projected portion 7.

In other words, according to the first embodiment, the tab portion 6 is made to have the necessary thickness despite the use of a thin metal plate, thereby making it possible to fabricate a more light-weight terminal fitting at reduced costs. Further, the strength of the tab portion 6 itself with the bead-like projected portion can be increased.

When the projected portion 7 is formed at the tab portion 6 as in the first embodiment, a portion of the tab portion 6 connected with the stabilizers 4, i.e., a base end 8 (neck portion) of the tab portion 6 may not have a sufficient strength. This may lead to a limitation in making the metal plate thinner.

In view of this, in a second embodiment shown in FIGS. 3 and 4, a projected portion 7*a* extending in the lengthwise direction as in the first embodiment is formed to extend from the leading end of the tab portion 6*a* to the base end 8.

With this projected portion 7*a*, the base end 8 of the tab portion 6*a* is allowed to have an increased flexural rigidity, thereby allowing the metal plate to be made even thinner.

In a third embodiment shown in FIGS. 5 and 6, a plurality of projected portions 7*b* extending in the widthwise direction are formed in spaced-apart relationship on the metal plate layer of a tab portion 6*b* having no seam.

In a fourth embodiment shown in FIGS. 7 and 8, a plurality of semispherical projected portions 7*c* are formed in two length-wise extending rows in offset relationship on the metal plate layer of a tab portion 6*c* having no seam.

In the third and fourth embodiments as well, the necessary thickness can be obtained despite the use of a thin metal plate and the strength of the tab portions 6*b* and 6*c* can be increased.

The present invention is not limited to male terminal fittings having the structures as shown in the foregoing embodiments, but may be applied to any male terminal fitting in which a tab portion is formed at a leading end of a barrel portion by folding back a metal plate such as the one in which the stabilizers projects in the same direction as the barrels and the one in which no stabilizer is provided.

In the embodiments described above, one or a plurality of projected portions are formed at the metal plate upper layer having no seam. However, it is also possible to provide projected portions in the metal plate lower layer (preferably in the neighbourhood of the seam). Finally, it is also possible to provide one or more projected portion(s) in the metal plate upper layer and metal plate lower layer. In the latter case, it is preferred that the projections in the metal plate upper layer and metal plate lower layer project in opposite directions. Finally, it may be considered to form one or more projected portions by co-embossing (press-working) the tab portion after having folded the tab portion.

What is claimed is:

1. An elongate male terminal fitting unitarily formed from a metal plate material having a selected thickness t, said male terminal fitting comprising opposed longitudinal ends, a barrel portion at one said longitudinal end for electrical connection to a wire, an engagement portion adjacent said barrel portion for engagement with a connector housing, a neck portion adjacent said engagement portion and tapering to a smaller cross-sectional dimension than said engagement portion, and a tab portion extending from said neck portion to the opposed longitudinal end for engagement in a mating female terminal fitting requiring a specified tab thickness T greater than twice t, said tab portion having opposed first and second longitudinally extending sides and opposed first and second layers, said second layer being formed from first and second coplanar lateral sections unitarily joined to said first layer along first and second folds extending from said neck portion to the opposed end and defining the respective first and second longitudinally extending sides of said tab portion, said first layer having planar portions disposed in face-to-face relationship with said second layer, said first layer further being embossed with at least one projection between the planar portions thereof and disposed to electrically engage said female terminal fitting, regions of said tab portion having said projection thereon substantially equaling said specified thickness required by said mating female terminal fitting, said projection extending from said tab portion into said neck portion of said elongate male terminal fitting for enhancing strength for said elongate male terminal fitting in proximity to said tab portion and said neck portion.

2. An elongate male terminal fitting unitarily formed from a metal plate material having a selected thickness t, said male terminal fitting comprising opposed first and second longitudinal ends, a barrel portion at said first longitudinal end for electrical connection to a wire, an engagement portion of generally rectangular cross-sectional shape adjacent said barrel portion for engagement with a connector housing, a neck portion adjacent said engagement portion and tapering to a smaller cross-sectional shape than said engagement portion, and a tab portion extending from said neck portion to the second longitudinal end for electrical engagement in a mating female terminal fitting requiring a specified tab thickness T greater than twice t, said tab portion having opposed first and second longitudinally extending sides and opposed first and second layers, said second layer being formed from first and second coplanar lateral sections unitarily joined to said first layer along first and second folds extending from said neck portion to said second longitudinal end and defining the respective first and second longitudinally extending sides of said tab portion, said first layer having planar portions adjacent the respective first and second longitudinally extending sides and disposed in face-to-face relationship with the respective first and second lateral sections of said second layer, and an embossed projection extending from said neck portion centrally along said first layer of said tab portion to a location in proximity to said second end of said tab portion including portions that are electrically engageable with said female terminal fitting, said embossed projection extending away from said second layer of said tab portion such that said tab portion defines said specified thickness T required by said mating female terminal fitting, whereby the thickness t for said metal plate material provides easy workability, and whereby the extending of said embossed projection from said neck portion centrally along said tab portion provides enhanced strength adjacent said neck and tab portions of said male terminal fitting.

* * * * *